United States Patent [19]

Althaus

[11] Patent Number: 4,601,392

[45] Date of Patent: Jul. 22, 1986

[54] SAFETY RAZORS AND TRAVEL CAPS THEREFOR

[75] Inventor: Wolfgang Althaus, Wuppertal, Fed. Rep. of Germany

[73] Assignee: Wilkinson Sword Limited, High Wycombe, England

[21] Appl. No.: 671,374

[22] Filed: Nov. 14, 1984

[30] Foreign Application Priority Data

Dec. 2, 1983 [GB] United Kingdom ..... 8332281

[51] Int. Cl.[4] ..... A45C 11/26

[52] U.S. Cl. ..... 206/349; 206/352; 206/355; 30/84

[58] Field of Search ..... 206/228, 349, 352, 354, 206/355, 820; 30/77, 84

[56] References Cited

U.S. PATENT DOCUMENTS

| | | | |
|---|---|---|---|
| 1,958,600 | 5/1934 | Wright | 206/228 |
| 2,695,448 | 11/1954 | Cavanaugh | 30/77 |
| 2,916,159 | 12/1959 | O'Neill | 206/820 |
| 2,969,140 | 1/1961 | Avetta | 206/349 |
| 3,241,658 | 3/1966 | Anderson | 206/820 |
| 3,331,129 | 7/1967 | Goudie | 30/77 |
| 3,845,860 | 11/1974 | Ladouceur et al. | 206/820 |
| 3,899,074 | 8/1975 | Lucas | 206/820 |
| 3,915,300 | 10/1975 | Gatley | 206/354 |
| 4,128,172 | 12/1978 | Joyce | 206/352 |
| 4,140,244 | 2/1979 | Clabby | 206/228 |
| 4,432,452 | 2/1984 | Kelly | 206/349 |
| 4,445,610 | 5/1984 | Richards | 206/349 |
| 4,450,980 | 5/1984 | Clabby et al. | 206/228 |
| 4,476,630 | 10/1984 | Byrne | 30/84 |

OTHER PUBLICATIONS

Packaging Review, May 1980.

*Primary Examiner*—Joseph Man-Fu Moy
*Assistant Examiner*—David Fidei
*Attorney, Agent, or Firm*—John K. Williamson

[57] ABSTRACT

A travel cap 10 for a T shaped safety razor 11 is designed to be slid on to the razor head 12 from one end of the latter, and comprises a first tubular portion 10*a* which fits around the heat to one side or the razor handle 13, and a second wrap-around portion 10*b* integral with the first portion and extending over the remaining length of the razor head, the longitudinal sides 10*c*, 10*d* of the wrap-around portion being spaced apart to define a slot 10*e* along which the razor handle 13 can slide.

7 Claims, 8 Drawing Figures

SAFETY RAZORS AND TRAVEL CAPS THEREFOR

BACKGROUND OF THE INVENTION

This invention relates to travel cap devices for safety razors, in particular for disposable razors, and to razors fitted with such devices.

Travel cap devices for disposable razors are well known. In a simple form the device comprises a trough-shaped travel cap of thin plastics material which fits resiliently over the razor head of a T shaped razor to shield the blade edge or blade edges thereof. Projections extending inwardly from opposite sides of such a travel cap engage over the razor head to hold the cap in place, relying on the resilience of the opposite sides of the cap for to permit engagement with, and disengagement from, the razor head. Such caps however become dislodged very easily from the razor and so cease to serve their purpose.

SUMMARY OF THE INVENTION

According to the present invention there is provided a travel cap device for a T-shaped safety razor of the type having a razor head containing one or more blades and a handle extending away from said razor head, the device comprising a cap shaped to fit over said razor head, the cap comprising a generally tubular wall having an opening extending along said wall from an open end of the cap up to a position beyond the mid length position of the cap to enable the head of the razor to be inserted into the cap until the handle is equidistant from the opposite ends of the cap.

In particular the cap comprises a portion of C-shaped cross-section extending from said open end up to said position beyond the mid length position, the remainder of the length of the cap up to the opposite end being of oval cross-section.

The present invention further provides a pack of disposable razors, each of substantially T shape comprising a head and a handle perpendicular thereto, each razor having a travel cap fitted thereon, the caps being secured together by frangible connections between adjacent caps, each cap having a first tubular portion fitted over the razor head to one side of the handle and a second wrap-around portion integral with the first portion and extending over the razor head alongside the handle and to the opposite side of the handle from the first portion, the wrap-around portion having edges extending along the razor head and spaced apart sufficiently to permit the razor head to be slid into and out of the cap.

BRIEF DESCRIPTION OF THE DRAWING

The invention will now be particularly described with reference to the accompanying drawings in which.

DESCRIPTION OF THE PREFERRED EMBODIMENT

Figure 1:
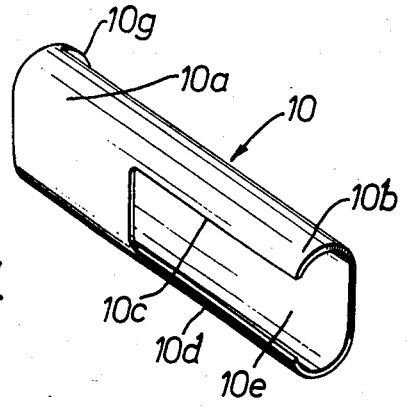
FIG. 1 is a perspective view of a travel cap, according to the present invention, for fitment to a safety razor.
Figure 2:
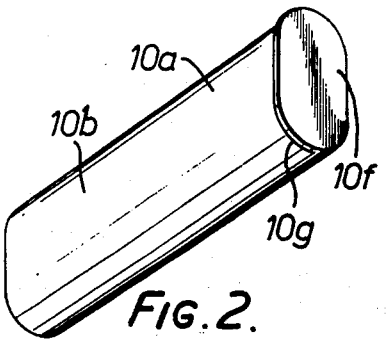
FIG. 2 is a perspective view of the travel cap of FIG. 1 as seen from the end opposite that of FIG. 1.

As shown in the drawings, the travel cap 10 is designed to fit over the head 12 of a disposable T shaped safety razor 11, to shield the cutting edge of the blade or blades located within the head. The razor has a handle 13 symmetrically disposed relative to and extending perpendicular to the head.

The cap, which is of generally oval cross-section and designed to fit slidably on to the head, comprises a first tubular portion 10*a* enclosing a first part of the head extending from one end of the head up to the handle 13 and a second wrap-around portion 10*b* extending over the remainder of the length of the razor head up to its opposite end. The wrap around portion has two terminal edges 10*c*, 10*d* extending parallel to the length of the razor head and spaced apart by a sufficient distance to allow the handle to pass along the slot 10*e* defined between said edges as the cap is fitted to, or removed from, the razor head.

It will be apparent that the cap is fitted to the razor head by being slid on to the razor head from one end thereof. The cap is removed by sliding in the opposite direction. The cap is located on the razor head by engagement of the handle with the inner end of the first or tubular portion. Accordingly the cap can be open at both ends. Alternatively it can be closed at the outer end of the tubular portion by an end wall 10*f*.

The travel cap is conveniently made of synthetic resin plastics material, preferably transparent, and dimensioned so that the tubular portion fits closely around one part of the head, whereas the wrap-around portion fits closely around the remainder. The resilience of the wrap around portion or the close fit of the tubular portion, or both, serve to prevent inadvertent removal of the cap from the razor head, yet are such as to permit easy movement of the cap on to or off the razor head.

In order to form a razor pack, a plurality of caps (for example five) can be secured or formed together in side-by-side relationship, being interconnected by connections between adjacent caps which can be frangible. These interconnections can extend along the length of each cap or secure the caps together at one end or both ends thereof.

A lip 10*g* can be formed, as shown, at the outer end of the tubular portion 10*a* of the cap for engagement with the thumb nail of the user to assist in withdrawing the cap from the razor.

Figure 3:
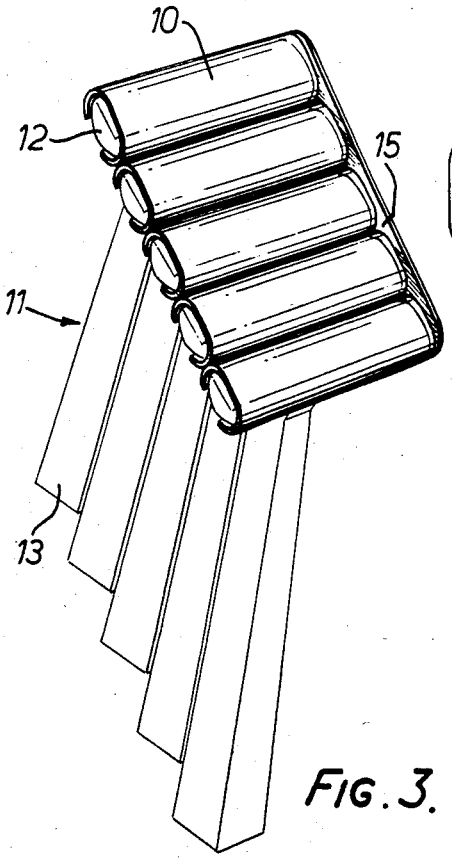
FIG. 3 is a perspective view of a combination of five travel caps each according to the invention, each having a razor fitted therein to form a sales pack of five razors.
Figure 4:
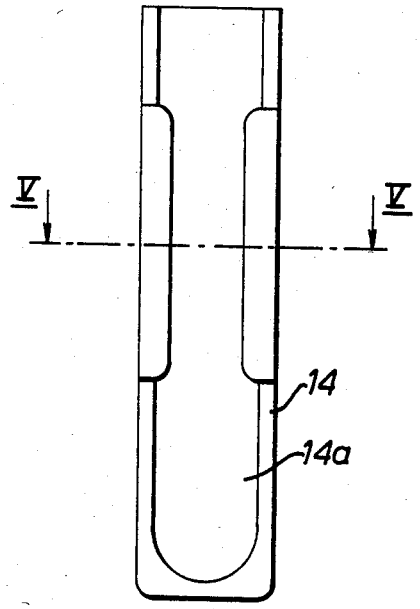
FIG. 4 is a plan view of a support plate adapted to be secured to a wall to receive and support a combination of travel caps such as is shown in FIG. 4.
Figure 5:
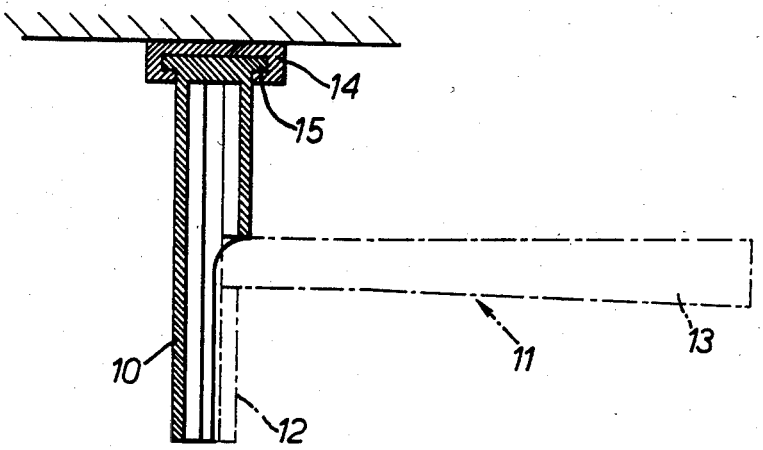
FIG. 5 is a section on the line V—V of FIG. 4 and showing a pack of razors supported on the support plate.

FIGS. 4 and 5 show a support plate 14 adapted to be fixed to a wall, for example of a bathroom, by adhesive or otherwise, the mounting plate having therein a channel 14*a* open at one end and into which can slide a parallel sided strip 15 moulded integrally with an assembly of five, or other number of, travel caps 10 (as seen in FIG. 3). Preferably the mounting plate 14 will be upright with its open end uppermost, but if the strip is dimensioned to fit tightly within the channel, any other orientation of the mounting plate can be used.

Accordingly, a pack of, for example, five razors held within a cap assembly can be fitted into and supported by the mounting plate as shown in FIG. 5, and individual razors can then be withdrawn for use, in a direction perpendicular to the wall, when required.

If the razors are used, starting with the uppermost razor as seen in FIG. 3 and thereafter working downwardly, a razor can, after use, be inverted when being fitted back into the appropriate cap, so that all 'used' razors will have their handles inclined upwardly, and all 'unused' razors will have their handles inclined downwardly.

The common supporting strip 15 is shown in the drawings to be secured to the end of each cap, so that the caps are supported by the mounting plate to extend therefrom in a cantilever manner. As an alternative however, the supporting strip could be located intermediate the ends of the caps so that the handles of the razors will extend away from the surface on which the mounting plate is fixed.

Figure 6:
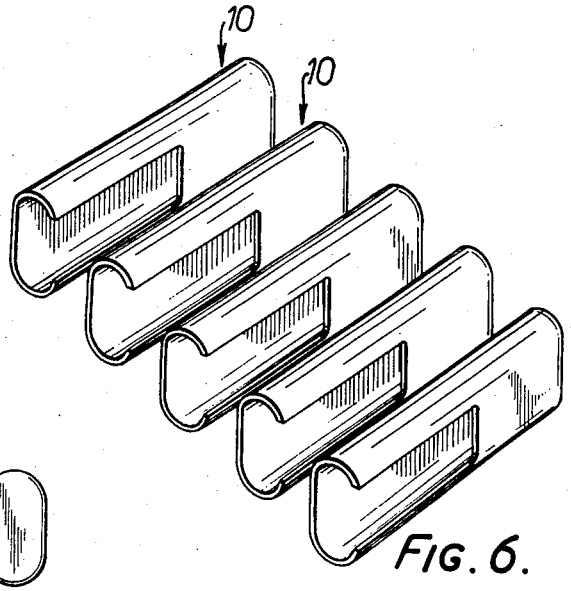
FIGS. 6, 7 and 8 are respectively a perspective view, an end elevation and a plan view of a staggered group of travel caps according to the invention.
Figure 7:
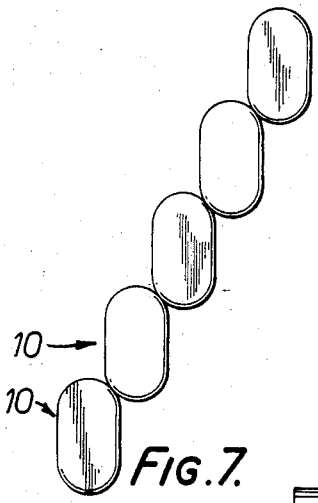
Figure 8:
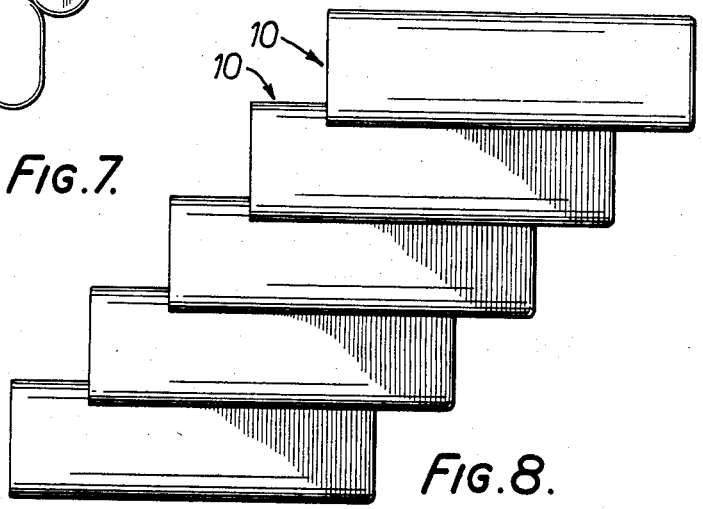

In a modification of the invention shown in FIGS. 6, 7 and 8, an assembly of, for example, five caps 10 are secured together in a staggered array, the caps can be staggered both longitudinally as best seen in FIG. 8 and laterally as best seen in FIG. 7. This arrangement makes a convenient and attractive sales pack when a corresponding number of razors have been fitted into the caps.

I claim:

1. A travel cap device for a plurality of T-shaped safety razors of the type having a razor head containing one or more blades and a handle extending away from said razor head, the device comprising a plurality of caps each shaped to fit over a respective razor head, each cap comprising a generally tubular wall having an opening extending along said wall from an open end of the cap up to a position beyond the mid length position of the cap to enable the head of its associated razor to be inserted into the cap until the handle is equidistant from the opposite ends of the cap said device further comprising means securing said caps together to receive said plurality of razors therein, the securing means between adjacent caps being frangible.

2. A travel cap device for a plurality of T-shaped safety razors of the type having a razor head containing one or more blades and a handle extending away from said razor head, the device comprising a plurality of caps each shaped to fit over a respective razor head, each cap comprising a generally tubular wall having an opening extending along said wall from an open end of the cap up to a position beyond the mid length position of the cap to enable the head of its associated razor to be inserted into the cap until the handle is equidistant from the opposite ends of the cap said caps being secured together by a common supporting strip integral with the end of each cap opposite said open end and forming an end closure of each cap.

3. A travel cap device according to claim 1 wherein each cap is staggered with respect to the next adjacent cap.

4. A travel cap device according to claim 2 further comprising a mounting plate adapted to be fitted to a wall surface and having a slot therein shaped to receive therein said common supporting strip thereby to support said plurality of caps.

5. A travel cap device according to claim 4 wherein the common supporting strip is secured to one end of each cap to extend perpendicular to the length of each cap so that the caps are supported in a position in which they extend from the mounting plate in a cantilever manner.

6. A pack of disposable razors, each of substantially T shape comprising a head and a handle perpendicular thereto, each razor having a travel cap fitted thereon, the caps being secured together by frangible connections between adjacent caps, each cap having a first tubular portion fitted over the razor head to one side of the handle and a second wrap-around portion integral with the first portion and extending over the razor head alongside the handle and to the opposite side of the handle from the first portion, the wrap-around portion having edges extending along the razor head and spaced apart sufficiently to permit the razor head to be slid into and out of the cap.

7. A pack of disposable razors, each of substantially T shape comprising a head and a handle perpendicular thereto, each razor having a travel cap fitted thereon, the caps being secured together by a common supporting strip secured to the caps, each cap having a first tubular portion fitted over the razor head to one side of the handle and a second wrap-around portion integral with the first portion and extending over the razor head alongside the handle and to the opposite side of the handle from the first portion, the wrap-around portion having edges extending along the razor head and spaced apart sufficiently to permit the cap to be slid on to and off the razor head, and a mounting plate adapted to be fitted to a wall surface and having a slot shaped to receive therein said common supporting strip and thereby to support the caps on the wall plate.

* * * * *